United States Patent [19]

Raasch

[11] 4,266,734

[45] May 12, 1981

[54] WINDING DEVICE

[75] Inventor: Hans Raasch, Mönchengladbach, Fed. Rep. of Germany

[73] Assignee: W. Schlafhorst & Co., Mönchengladbach, Fed. Rep. of Germany

[21] Appl. No.: 816,689

[22] Filed: Jul. 18, 1977

[30] Foreign Application Priority Data

Jul. 16, 1976 [DE] Fed. Rep. of Germany ..... 2632014

[51] Int. Cl.[2] ..... B65H 54/46; B65H 54/28

[52] U.S. Cl. ..... 242/18 DD; 242/43 R; 242/43.2

[58] Field of Search ..... 242/18 DD, 43 R, 43.2

[56] References Cited

U.S. PATENT DOCUMENTS

| | | | |
|---|---|---|---|
| 1,126,809 | 2/1915 | McKean | 242/43 R |
| 1,427,035 | 8/1922 | Taylor | 242/43 R |
| 1,591,138 | 7/1926 | McKean | 242/43 R |
| 3,053,464 | 9/1962 | Trost | 242/43.2 |
| 3,227,385 | 1/1966 | O'Brien | 242/43.2 |

FOREIGN PATENT DOCUMENTS

| | | | |
|---|---|---|---|
| 1144163 | 2/1963 | Fed. Rep. of Germany | 242/18 DD |
| 21652 | of 1910 | United Kingdom | 242/18 DD |
| 21653 | of 1910 | United Kingdom | 242/18 DD |

*Primary Examiner*—Stanley N. Gilreath
*Attorney, Agent, or Firm*—Herbert L. Lerner

[57] ABSTRACT

A winding device for a conical cross-wound coil wherein the coil is driven by peripheral friction applied to a predetermined part of the length thereof constituting a friction zone, and the thread that is to be wound on the coil is fed thereto by a thread guiding member, means for reducing the angle at which the wound threads cross on the cross-wound coil in the friction zone with respect to the thread crossing angle outside the friction zone.

5 Claims, 3 Drawing Figures

WINDING DEVICE

Figure 1:
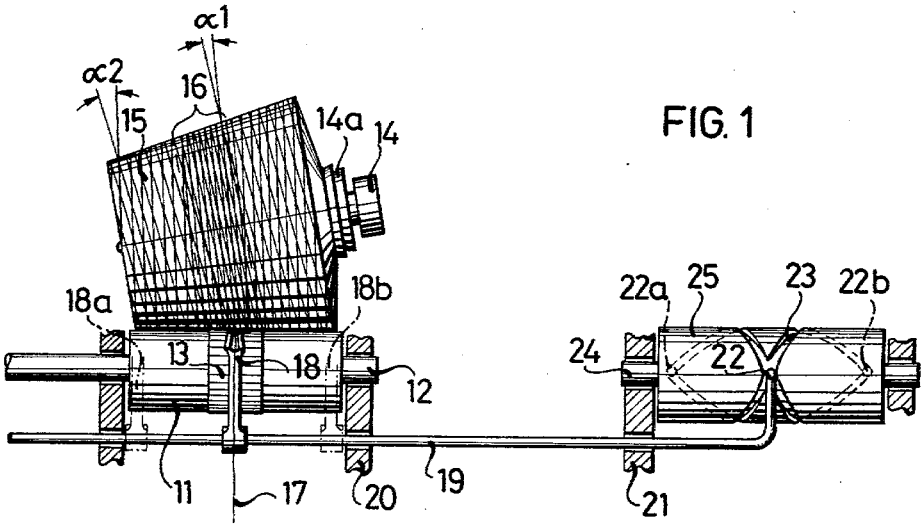

The invention relates to a winding device for conical cross-wound coils or cheeses wherein the cross-wound coils, respectively, that are to be wound are driven at a predetermined part of the length thereof in a so-called friction zone by peripheral friction, and thread that is to be wound is fed to the cross-wound coil by a thread guiding member. Such winding devices are used both at constant as well as at variable thread guiding velocity. During the winding of a thread layer, the rotary speed of the conical cross-wound coil remains substantially constant, in such a case. With increasing fullness of the coil winding, the rotary speed of the cross-wound coil diminishes on the pre-condition that the coil driving device rotates at a constant velocity.

Since the conical cross-wound coil is usually in engagement with a drive roller which, on a given part of the length thereof has a friction zone of increased friction value projecting somewhat from the surface of the roller, a saddle-shaped appearance of the friction zone at the conical cross-wound coil makes itself disadvantageously noticeable with increasing fullness of the winding on the coil. After the beginning of the winding operation, contact of the coil with the drive roller over the entire conical surface of the coil occurs quite rapidly. The result thereof is that the specific bearing pressure of the coil diminishes in the region of the friction zone to such an extent that the coil surface accommodates or accepts contact with the drive roller. Finally, the coil becomes driven no longer solely in the friction zone but also at other locations of the periphery. The rotary speed of the cross-wound coil thereby becomes unsteady an uncontrollable because, in the case of conical coils, the peripheral length of the coil is variable.

For variable thread feeding velocity, these deviations of the rotary speed of the coil make themselves disadvantageously apparent in variations of the average winding velocity, by which average is meant the average value resulting from the varying winding velocities per thread guide double-stroke. If the friction zone shifts toward the smaller coil diameter, the average winding velocity becomes greater. If the friction zone shifts toward the larger coil diameter, the average winding velocity becomes smaller. If the friction zone is disposed at the coil end, sloughing-off of the threads is to be feared.

For constant thread feeding velocity, a thread storage device can, in fact, compensate for the varying thread run-up velocity between the small and the large diameters of the conical cross-wound coil during a thread guide double stroke and, thereby, also take into account the reduction of the thread storage length with increased fullness of winding on the coil, but cannot equalize or balance random variations of the average value of the winding velocity. In this case, therefore, variations in the thread tension are set and, in fact, in especially disadvantageous manner as continuing tension variation with increasing fullness of winding of the coil. The coil is wound with quite different thread tension from beginning to end of the winding process. The character or structure of the thread and the coil is lastingly or permanently different and therewith the quality is disadvantageously varied.

It is accordingly an object of the invention to provide a winding device of the hereinaforedescribed type wherein the average winding velocity remains constant during the entire winding process and shifting of the friction zone is prevented.

With the foregoing and other objects in view, there is provided, in accordance with the invention, in a winding device for a conical cross-wound coil wherein the coil is driven by peripheral friction applied to a predetermined part of the length thereof constituting a friction zone, and the thread that is to be wound on the coil is fed thereto by a thread guiding member, means for reducing the angle at which the wound threads cross on the cross-wound coil in the friction zone with respect to the thread crossing angle outside the friction zone. The smaller crossing angle results in a denser packing of the coil package or body in the predetermined friction zone, so that there exists during the entire winding process, a higher specific compression of the conical cross-wound coils lying against the drive roller. For this reason, the conical cross-wound coils are driven during the entire winding process in the same predetermined friction zone. The resistance to compression of the coil is readily increased in the friction zone, in accordance with the invention.

In accordance with another feature of the invention, the thread guiding member is reciprocable in front of the cross-wound coil, and means are provided for reducing the axial stroke of the thread guiding member during the time interval wherein the thread is fed to the cross-wound coil in the friction zone. Such means may be formed, for example, of a control roller having a control cam of such shape that the motion of the thread guide is slowed down when it travels past the friction zone of the cross-wound coil.

In accordance with a further feature of the invention, the thread guiding member is a thread guiding drum and the latter is formed with a thread guiding groove having a slope in a region thereof disposed in front of the friction zone of the cross-wound coil that is smaller than at locations thereof outside the region. At constant rotary speed of the thread guiding drum, a smaller thread crossing angle of the cross-wound coil is attained due to the smaller slope in the region of the friction zone. The thread guiding drum can itself receive thereon a friction layer or also be provided alongside of a special coil driving device.

Since the necessary variation of the thread crossing angle is dependent upon the bearing pressure of the cross-wound coil, upon the character or structure of the thread, upon the winding velocity and the like, there are provided, in accordance with an added feature of the invention, means for adjusting the extent of decrease in the thread crossing angle in the friction zone. Such means are, for example, a device for adjusting the variation in the thread guide velocity.

A reciprocating thread guide can be controlled by a suitably formed control cam so that is slows down the movement thereof as it passes in front of the friction layer. The transition from the faster to the slower movement and vice versa, advantageously does not occur haltingly, but rather, occurs smoothly. To adjust the thread crossing angle, an assortment of different parts of the thread guide driving device possessing control cams can be held available so as to be readily exchangeable. It is advantageous not to exchange the control cam per se, but rather, to connect an adjustable couple transmission between the thread guide driving device and the thread guide, through which the velocity of the thread guide during a thread guide stroke is selectively varied.

In accordance with an additional feature of the invention, the reduction of the thread crossing angle of the cross-wound coil in the friction zone with respect to the average value of the thread crossing angle over the length of the coil extends selectively to values up to a maximum of 15%. In a reduction of the thread guide velocity during the passing of the thread guide in front of the friction zone, an optimum of 10% of the average value is attained in accordance with the invention. The completed cross-wound coil does not differ externally from cross-wound coils of conventional construction. The friction zone can neither be seen nor determinable by any sensor. The variation of the thread crossing angle cannot be determined by merely examining the surface of the coil.

In accordance with a concomitant feature of the invention, the coil driving device is in the form of a roller, more specifically, a drive roller or a grooved thread guiding drum, the friction zone of the coil driving device being a substantially ring-shaped zone of increased frictional value having an outside diameter equal to that of the remainder of the coil driving device. The cross-wound coil thereby always has contact with the drive roller or the thread guiding drum along a line of the conical surface. However, the drive occurs in the zone of increased friction value in the event the cross-wound coil in the crossing zone also receives the desired sturdier construction. The thread running up onto the cross-wound coil is not disturbed in the course of movement thereof by a projecting friction zone. At the beginning of the winding operation, the thread extension on the coil core and the winding of the first thread layers are also facilitated due to the uniform surface of the coil driving device.

The rotary speed of the cross-wound coil remains constant during the time-span of a thread guide stroke. No unduly large deviations of the thread tension therefore occur. Especially, the deviations and variations of the thread tension extending over very great time intervals are considerably more uniform and smaller than during winding of the conventional type. Moreover, the average thread withdrawal velocity also remains constant, so that winding can be effected at constant thread feeding velocity, provided that a thread storage device, the capacity of which can be reduced with increasing fullness of winding on the coil, which compensates during the movement of the thread from the middle of the coil to one of the coil ends, from there to the other coil end and back again to the middle of the coil, compensates for the varying capacity of the conical cross-wound coils. This compensation is not disturbed by the fact that, in a conventional manner, the driving point wanders quite uncontrolledly over the coil surface.

Other features which are considered as characteristic for the invention are set forth in the appended claims.

Although the invention is illustrated and described herein as embodied in a winding device, it is nevertheless not intended to be limited to the details shown, since the various modifications and structural changes may be made therein without departing from the spirit of the invention and within the scope and range of equivalents of the claims.

Figure 2:
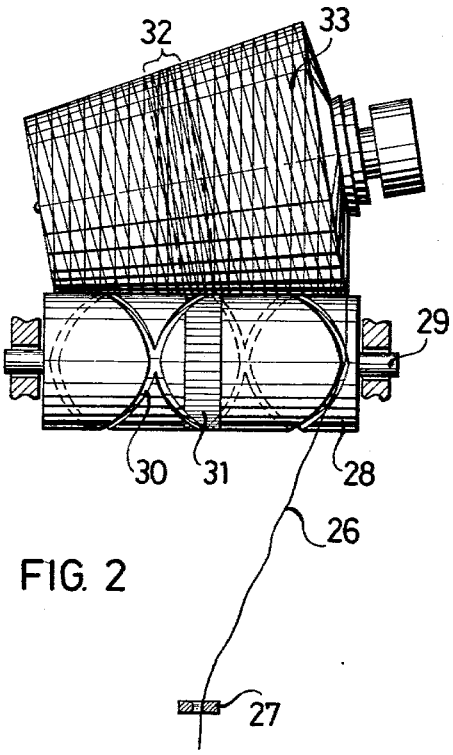
Figure 3:
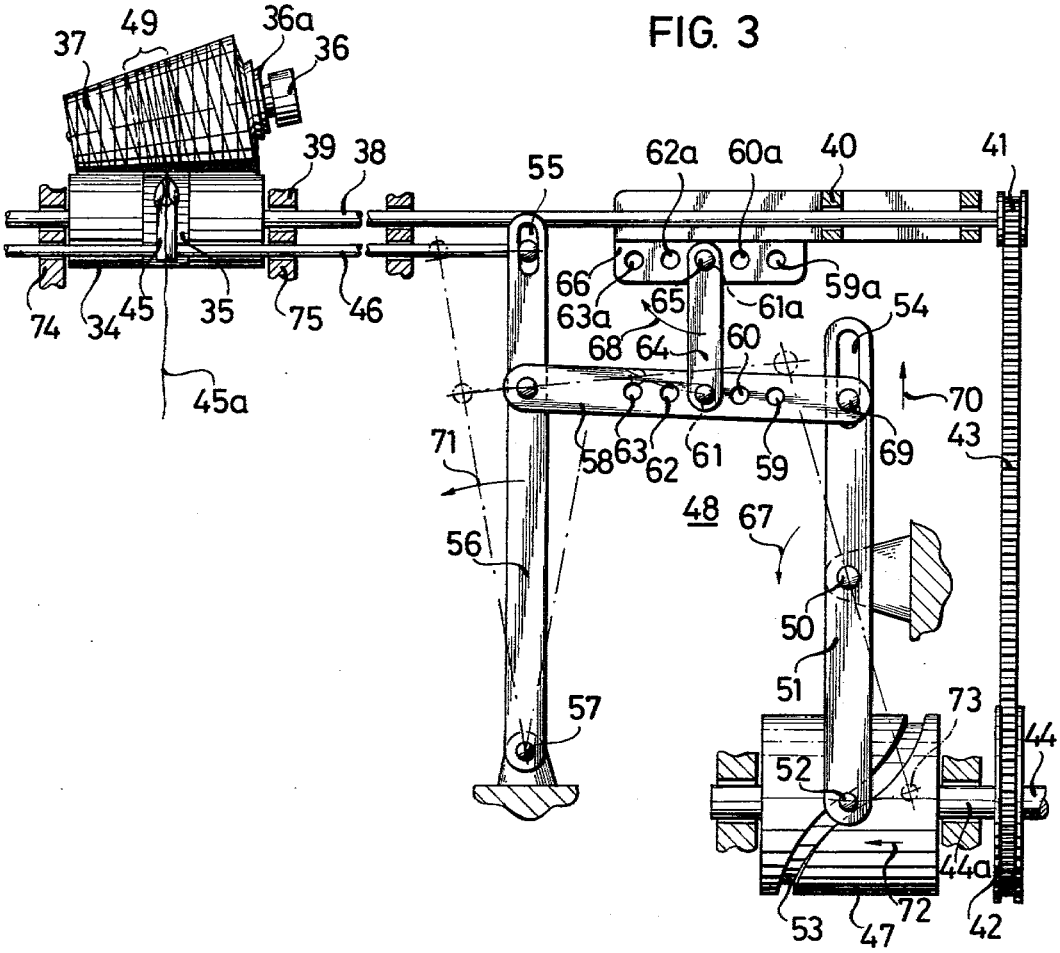

The construction and method of operation of the invention, however, together with additional objects and advantages thereof will be best understood from the following description of specific embodiments when read in connection with the accompanying drawings, in which:

FIGS. 1, 2 and 3 are elevational views, partly in section, of three different embodiments of the winding device according to the invention.

Referring now to the drawing and first, particularly, to FIG. 1 thereof there is shown an embodiment of the winding device of the invention which has a coil driving device in the form of a drive roller 11 having a shaft that is driven at constant rotary speed. The drive roller 11 has, in the middle thereof, a friction zone 13 having an increased friction value or coefficient of friction which projects somewhat out of the surface of the roller 11. A conical cross-wound coil or cheese 15 held by a coil frame 14, **14*a* articulatingly and pivotably suspended in a conventional manner is driven by peripheral friction exerted by the rotating drive roller 11. This drive occurs only in the region of the friction zone 13 or in the region of the friction zone 16 of the coil 15. The other parts of the conical shell of the coil 15, at the illustrated extent of fullness of the coil 15, also roll around on the drive roller due to the elasticity of the coil 15, without contributing, however, to the rotating drive of the coil 15**.

The thread 17 that is to be wound on the coil 15 is guided by a reciprocating thread guide 18 so that it runs between drive roller and coil onto the cross-wound coil 15 in crosswise thread layers. The thread guide 18 is reciprocated by a rod 19. The rod 19 is guided in slide bearings 20, 21 and carries at an end thereof a pick-up pin or stylus 22 engaging in a control groove 23 formed in a control drum 25 driven by a shaft 24 at constant rotary speed. It is clearly apparent that the slope or inclination of the control groove 23 in the middle of the control drum 25 is smaller than in the other regions thereof. This great deviation of the slope or inclination selected in an obvious manner is not made use of in practice, however, and is limited only to values which do not permit ready perception or detection optically of deviations.

During a half rotation of the control drum 25, the pick-up or sensing pin 22 initially reaches the position identified as **22*a*; while the thread guide 18 simultaneously assumes the position thereof identified as 18*a*. After another half rotation or turn of the control drum 25, the pick-up or sensing pin 22 and the thread guide 18 are located again in the position thereof shown in FIG. 1. Upon further turning or rotation of the control drum 25, the sensing or pick-up pin 22 reaches the position 22*b* thereof and the thread guide 18 the position 18*b* thereof. Upon the completion of the second turn or rotation of the control drum 25, both parts i.e. the pick-up pin 22 and the thread guide 18, again assume the positions thereof illustrated in FIG. 1. Each time the thread guide 18 is drawn past the friction zone 13 of the drive roller 11 or past the friction zone 16 of the conical cross-wound coil or cheese 15, the speed thereof is diminished. Since the cross-wound coil 15 rotates at a constant speed during the stroke of the thread guide, the thread crossing angle $\alpha$, in the friction zone 16 is, consequently, smaller than the thread crossing angle $\alpha_2$ outside the friction zone 16**.

In accordance with the second embodiment of the invention which is illustrated in FIG. 2, a thread 26 is fed through a thread guiding eye 27 to a grooved thread guiding drum 28. The latter has a shaft 29 which rotates at a constant speed. The thread guiding groove 30 is incised in three turns in the thread guiding drum 28. In the middle of the thread guiding drum 28, a substantially ring-shaped or annular friction zone 31 is so disposed as to have an outer diameter equal to that of the thread guiding drum 28 per se. In the region of this friction zone 31, which is intersected obliquely by the thread guiding groove 30 at two locations, visible, in fact, in FIG. 2 at the top and the bottom of the drum 28, the slope of the thread guiding groove 30 is smaller than in the adjacent regions. A result thereof is that the thread 26, during rotation of the thread guiding drum 28 at constant speed, remains longer in the region of the friction zone 32 of the conical cross-wound coil or cheese 33 lying in engagement with the thread guiding drum 28 than it does in the other regions.

Accordingly the desired smaller thread crossing angle $\alpha_1$ is again produced in the friction zone 32.

In the third embodiment of the invention according to FIG. 3, a drive roller 34 with a friction zone 35 is again readily recognizable. A conical cross-wound coil or cheese 37 held by a coil frame 36, 36*a* is driven as a result of peripheral friction by a drive roller 34. The drive roller 34 has a shaft 38 which is mounted in slide bearings 39, 40 and rotates at constant speed. The drive thereof is effected by a belt pulley 41, a toothed or V-belt 43 and a belt pulley 42 from a drive shaft 44 of a non-illustrated motor. A reciprocating thread guide 45 delivers a thread 45*a* to the cross-wound coil 37. The thread guide 45 is secured to a rod 46 which is supported in slide bearings 74, 75. A control drum 47, just as in FIG. 1, is decisive for maintaining the movement of the thread guide 45 in the embodiment of FIG. 3. The control drum 47 is directly driven through the elongation or extension 44*a* of the shaft 44, so that control drum 47 and drive roller 34 run synchronously.

An adjustable couple transmission 48 is connected between the control drum 47 and the rod 46. The couple transmission 48 renders it possible, during the thread guiding stroke, to exert an effort upon the thread guide velocity so that the thread guide 45 moves more slowly in front of the friction zone 35 of the drive roller 34 or in front of the friction zone 49 of the conical cheese 37 than outside of these regions or zones 35 and 49.

The couple transmission has a rocker arm 51 pivotable about a swivel joint 50, the rocker arm 51 carrying at one end thereof a sensing or pick-up pin 52 which engages in a control groove formed in the control drum 47. At the other end of the rocker arm 51, an elongated hole or slot 54 is formed. The end of the rod 46 is articulatingly connected to a lever 56 through the use of an elongated hole or slot formed in the lever 56, the lever 56 being pivotable at an end thereof about a swivel joint 57.

The rocking motion of the rocker arm 51 is transmitted by a strap 58 to the lever 56. For this purpose, the strap 58 is connected at one end thereof articulatingly to the lever 56 and at the other end thereof articulatingly and, with a swivel connection 69, simultaneously in the slot 54 slidingly connected to the rocker arm 51. The strap 56 is formed with a row of holes 59 to 63. From a respective one of these holes 59 to 63, a steering lever 64 is able to be suspended at one end thereof; the other end of the steering lever 64 carrying a pin 65. The pin 65 is selectively insertable into one of a row of holes 59*a* to 63*a* formed in a stationarily secured perforated strip 66. According to FIG. 3, the pin 65 of the steering lever 64 is inserted into the hole 61*a*, so that it is rotatable about the central axis of the hole 61*a*. The steering lever 64, at the other end thereof, is articulatingly suspended into the hole 61.

If the rocker arm 51 then rocks, controlled by the control drum 47, in direction of the arrow 67, the steering lever 64 is simultaneously deflected in direction of the arrow 68, whereby the swivel connection 69 of the strap 58 travels in the slot 54 in direction of the arrow 70 so that the strap 58 acts upon a longer lever arm of the rocker arm 51. With the increase in length of this lever arm, the lever 56 is rotated with increasing velocity in direction of the arrow 71, and the rod 46 is shifted toward the left-hand side of FIG. 3 also with increasing velocity. This results in an increasing velocity of the thread guide 45, so that the thread guide 45 possesses a higher velocity outside the region disposed in front of the friction zone 49 than within this region.

When the rocker arm 51 rocks or swings back, the pick-up or sensing pin 52 thereof travels from the position 73 thereof, shown in phantom in FIG. 3, in direction of the arrow 72.

The described course of movement of the movable parts of the couple transmission 48 then reverses itself until the neutral midposition thereof illustrated in FIG. 3 is again attained. If the rocker arm 51 then rocks or swings in a direction opposite that of the arrow 67 to the other end position, the swivel connection 69 is also again forced by the steering lever 64 to travel in the slot 54 in direction of the arrow 70. The strap 58 thereby acts again upon a lengthening lever arm of the rocker arm 51 so that the thread guide 45, this time toward the other side, forcibly receives an increasing velocity. The change of the effective lever arm of the rocker arm 51 and, accordingly, the change of thread guide velocity becomes greater, if the steering lever 64 is inserted into holes disposed farther toward the right-hand side, for example, into the holes 60, 60*a* or 59, 59*a*. In reverse, the aforementioned lever arm becomes smaller, if the steering lever 64 is inserted into holes farther to the left-hand side, as viewed in FIG. 3, for example, the holes 62, 62*a* or 63, 63*a*. The extent to which the thread crossing angle is reduced in size is thus adjustable in a relatively simple manner by the intermediate connection of the couple transmission 48.

As mentioned hereinbefore, the invention of the instant application is not limited by the illustrated and aforedescribed embodiments. The friction layer, for example, need not be disposed absolutely in the middle of the drive roller or thread guiding drum. The couple transmission 48 can also have a different construction and can be provided with an infinite rather than stepwise adjustment system.

There are claimed:

1. In a winding device for a conical cross-wound coil wherein the coil is driven by peripheral friction applied to a predetermined part of the length thereof constituting a friction zone by a drive roller extending along the entire length in the coil, and the thread that is to be wound on the coil is fed thereto by a thread guiding member, means for traversing the yarn across the coil so as to produce a cross-wound coil, means for reducing the angle at which the wound threads cross on the cross-wound coil in the friction zone with respect to the thread crossing angle outside the friction zone.

2. Winding device according to claim 1 wherein the thread guiding member is reciprocable in front of the cross-wound coil, and said angle-reducing means comprise means for reducing the speed of the axial stroke of the thread guiding member during the time interval wherein the thread is fed to the cross-wound coil in the friction zone.

3. Winding device according to claim 1 wherein the thread guiding member and the drive roller constitute a thread guiding drum and wherein the thread guiding drum is formed with a thread guiding groove having a slope in a region thereof disposed in front of the friction zone of the cross-wound coil that is smaller than at locations thereof outside said region.

4. Winding device according to claim 1 including means for adjusting the extent of decrease in the thread crossing angle in the friction zone.

5. Winding device according to claim 1 wherein said angle reducing means for reducing the thread crossing angle of the cross-wound coil in the friction zone is capable of reducing said angle selectively to a value up to a maximum of 15% thereof with respect to a mean value of the thread crossing angle over the length of the cross-wound coil.

* * * * *